United States Patent [19]

Haytayan

[11] Patent Number: 4,655,380

[45] Date of Patent: Apr. 7, 1987

[54] POWDER-ACTUATED FASTENER-DRIVING TOOL

[75] Inventor: Harry M. Haytayan, Lincoln, Mass.

[73] Assignee: Pneutek, Inc., Hudson, N.H.

[21] Appl. No.: 779,879

[22] Filed: Sep. 25, 1985

Related U.S. Application Data

[63] Continuation of Ser. No. 497,701, May 24, 1983, abandoned.

[51] Int. Cl.[4] ..... B25C 1/08; B25C 1/10; B25C 1/14

[52] U.S. Cl. ..... 227/9; 227/10

[58] Field of Search ..... 227/9, 10, 11; 89/1 B; 42/1 R

[56] References Cited

U.S. PATENT DOCUMENTS

| | | | |
|---|---|---|---|
| 3,168,744 | 2/1965 | Kvavle | 227/10 |
| 3,499,590 | 3/1970 | Bayer et al. | 227/10 |
| 3,552,625 | 1/1971 | Udert | 227/10 |
| 3,554,425 | 1/1971 | Oesterle | 227/10 |
| 3,565,313 | 2/1971 | Seghezzi | 227/10 |
| 3,679,118 | 7/1972 | Maier et al. | 227/10 |
| 3,743,159 | 7/1973 | Schneider | 227/10 |
| 3,860,161 | 1/1975 | Engstrom | 227/10 |
| 4,153,193 | 5/1979 | Urbanowicz | 227/156 |

FOREIGN PATENT DOCUMENTS

| | | | |
|---|---|---|---|
| 2223160 | 11/1973 | Fed. Rep. of Germany | 42/1 R |
| 2405743 | 8/1975 | Fed. Rep. of Germany | 227/10 |

OTHER PUBLICATIONS

Bossong Manual, Bossong S.P.A.

*Primary Examiner*—Howard N. Goldberg
*Assistant Examiner*—Taylor J. Ross
*Attorney, Agent, or Firm*—Schiller, Pandiscio & Kusmer

[57] ABSTRACT

An improved powder-actuated fastener-driving tool is provided which is characterized by (a) improved gas exhaust passages for venting the hot gases of combustion from the interior of the tool, (b) an improved trigger assembly which is simple and reliable in its operation and adapted to be easily disassembled, and (c) an improved cartridge advance mechanism. The invention also includes an improved pole assembly which is detachably secured to the tool and has a unique remote tool-actuating mechanism.

11 Claims, 21 Drawing Figures

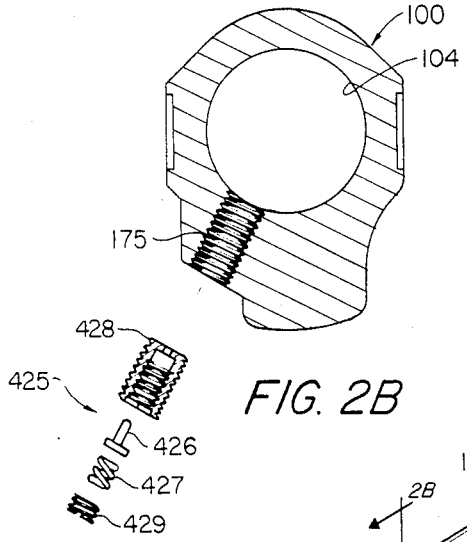
FIG. 2B
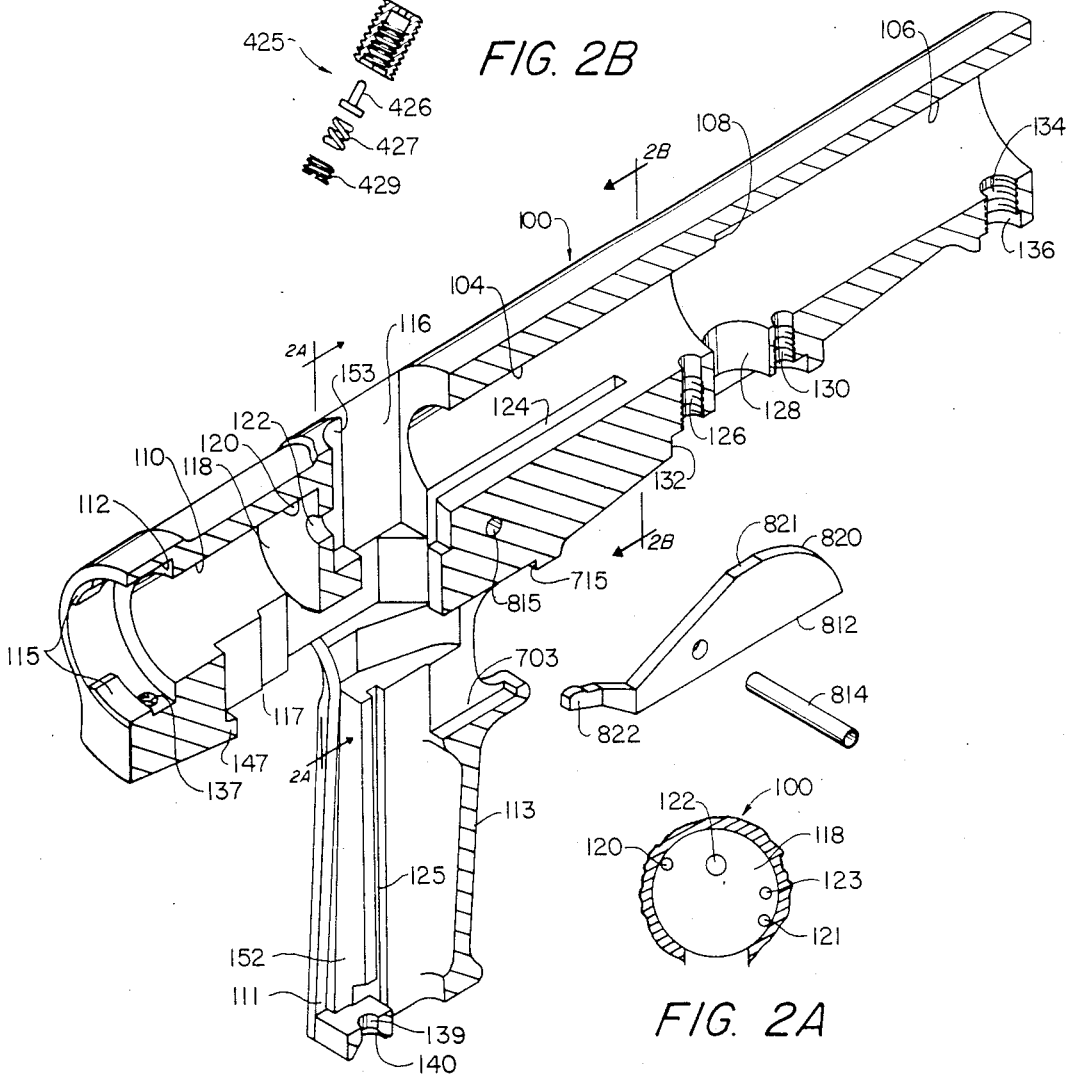
FIG. 2A
FIG. 2

POWDER-ACTUATED FASTENER-DRIVING TOOL

This is a continuation of U.S. patent application Ser. No. 497,701, filed May 24, 1983, now abandoned.

FIELD OF THE INVENTION

This invention relates to fastener-driving tools in general, and more particularly to powder-actuated fastener-driving tools.

BACKGROUND OF THE INVENTION

Fastener-driving tools are well known in the art. Such tools can generally be classified into two broad classes of tools, based on their source of driving power. The first class of tools, sometimes referred to as fluid-powered fastener-driving tools, depend on the use of pressurized fluids (e.g., air) to provide their driving power. Such tools are exemplified by the following U.S. Pat. Nos.: 3,952,398, 4,040,554, 4,122,904, 4,196,833 and 4,346,831. The second class of tools, sometimes referred to as powder-actuated fastener-driving tools, depend on the use of explosive cartridges to provide their driving power. Such tools are in turn exemplified by the following U.S. Pat. Nos.: 3,168,744, 3,499,590, 3,552,625, 3,554,425, 3,565,313 and 3,743,159.

Unfortunately, existing powder-actuated fastener-driving tools of the type which are adapted to accept a strip of charges tend to suffer from a number of serious problems. Typically, these tools tend to have a complex construction, so that they are relatively expensive to manufacture, fairly difficult to assemble, and prone to mechanical failure. Second, in many powder-actuated fastener-driving tools, the exhaust passages used to vent the hot gases of combustion from the interiors of the tools are inadequate for the task required; as a result, the tools are relatively noisy, have significant recoil, are energy inefficient, and/or tend to jam often on account of the buildup of spent powder within the tools. Third, none of the existing powder-actuated fastener-driving tools is capable of using a so-called "Red" charge cartridge (also known in the industry as a "Power Level 5" cartridge, or simply a "No. 5" cartridge) with a light-weight fastener (e.g., a ½" long nail) and still be considered a "low velocity" tool. In this respect, it is noted that a "low velocity" tool is one which has a maximum velocity of 300 feet per second measured six feet from the muzzle. Another problem with many powder-actuated fastener-driving tools is that they have a construction which does not allow for easy disassembly in the field so as to facilitate maintenance. Another common limitation of prior designs is that they cannot be easily adapted to drive fasteners of differing types and dimensions. Also existing powder-actuated fastener-driving tools are typically not easily adapted to be mounted to a pole assembly or else available pole assemblies for such tools are inconvenient to use or permit accidental firing.

In addition to the aforementioned problems common to many existing tools, at least one tool of that type also utilizes a trigger assembly of relatively great complexity, so that the aforementioned problems of expense of manufacture, difficulty of assembly, and tendency towards mechanical failure are exacerbated. In addition, at least one existing powder-actuated fastener-driving tool utilizes a cam arrangement in its cartridge advance mechanism which tends to wear excessively, so that increased maintenance is required or tool jamming may occur.

OBJECTS OF THE INVENTION

Accordingly, the principal object of the present invention is to provide a powder-actuated fastener-driving tool which is specifically adapted to avoid the foregoing problems which are associated with the prior art tools.

More specifically, one of the objects of the present invention is to provide a powder-actuated fastener-driving tool of the magazine type which is relatively cheap to manufacture, fairly easy to assemble, reliable in its operation and virtually jam-free.

Another object of the invention is to provide a powder-actuated fastener-driving tool which is equipped with improved exhaust passages for venting the hot gases of combustion from the interior of the tool, in order that the tool will be quieter, have less recoil, be more energy efficient (and hence, more powerful), and have less tendency to jam on account of the buildup of spent powder residue within the interior of the tool.

Still another object of the invention is to provide a powder-actuated fastener-driving tool which is capable of using a so-called "Red" charge cartridge with a light weight fastener and still be considered a "low velocity" tool.

Yet another object of the invention is to provide a powder-actuated fastener-driving tool which is easy to disassemble in the field, in order to facilitate maintenance.

And another object of the invention is to provide a powder-actuated fastener-driving tool which can be easily adapted to drive fasteners of differing types and dimensions.

Yet another object of the invention is to provide a powder-actuated fastener-driving tool which is easily adapted for use in conjunction with a pole assembly of superior design so as to form a superior pole tool.

Still another object of the invention is to provide a powder-actuated fastener-driving tool having a trigger assembly which is simple, relatively cheap to manufacture, fairly easy to assemble, reliable, and does not cause the tool to jam.

Another object of the invention is to provide a powder-actuated fastener-driving tool which uses an improved cam arrangement in its cartridge advance mechanism, in order that cam wearing will be minimized and maintenance and tool jamming reduced.

SUMMARY OF THE INVENTION

These and other objects are achieved by the present invention, which comprises a powder-actuated fastener-driving tool having the following improvements over prior art tools. First, the present invention utilizes a trigger assembly comprising a release lever pivotally supported for movement toward and away from the tool's firing mechanism, a torsion spring yieldably biasing the release lever away from the firing mechanism, a trigger, and a trigger push rod coupling the trigger to the release lever so as to cause the trigger to force the release lever in a direction to activate the firing mechanism when the trigger is pulled. Second, the present invention utilizes a cam in the tool's cartridge advance mechanism which has a generally rounded upper surface, but with a flat intermediate section on a portion of that upper cam surface. Third, the present invention utilizes a cylinder member which has first, second and third enlarged diameter cylindrical portions on the exterior of the cylinder member, the first portion being disposed near the rear, the second portion being disposed near the middle, and the third portion being disposed near the front of the cylinder member. The cylinder member also has a longitudinal rib extending between the first and second cylindrical portions, with the longitudinal rib having a rear section of substantially increased width. The cylinder's bottom hole for receiving a projecting portion of the tool's cylinder stop assembly is disposed in the longitudinal rib, and the cylinder's groove for receiving the cam of the cartridge advance mechanism is disposed in the rear rib section of substantially increased width. The cylinder member also has a plurality of vent holes in its second cylindrical portion for venting gases from the interior of the cylinder member to the exterior of the cylinder member. These vent holes extend at an acute angle relative to the longitudinal axis of the cylinder and communicate with grooves in the exterior surface of the second cylindrical portion. The third cylindrical portion has a pair of slots for conducting the gases towards the tool's barrel member, and the latter is shaped to allow gases to exit the tool. Fourthly, the present invention utilizes a hand guard which replaces the conventional long bottom slot normally found in hand guards with a short slot and a groove formed continuous with that slot, so as to limit premature exiting of gases from the tool. In addition, the hand guard has a plurality of circumferential flats disposed on the exterior surface of the cylindrical portion of the hand guard, in order to minimize binding between the hand guard and the tool housing on account of the buildup of spent powder residue in that region of the tool.

BRIEF DESCRIPTION OF THE DRAWINGS

Still other objects and features of the present invention will be more fully disclosed or rendered obvious in the following detailed description of the preferred embodiment of the invention, which is to be considered together with the accompanying drawings wherein like numbers refer to like parts and further wherein:

FIG. 2 is an exploded perspective sectional view of portions of the tool's housing assembly and cartridge advance mechanism;

FIG. 2A is a sectional view, with portions broken away, taken along line 2A—2A of FIG. 2;

FIG. 2B is a sectional view taken along line 2B—2B of FIG. 2:

DETAILED DESCRIPTION OF THE PREFERRED EMBODIMENT

Figure 1:
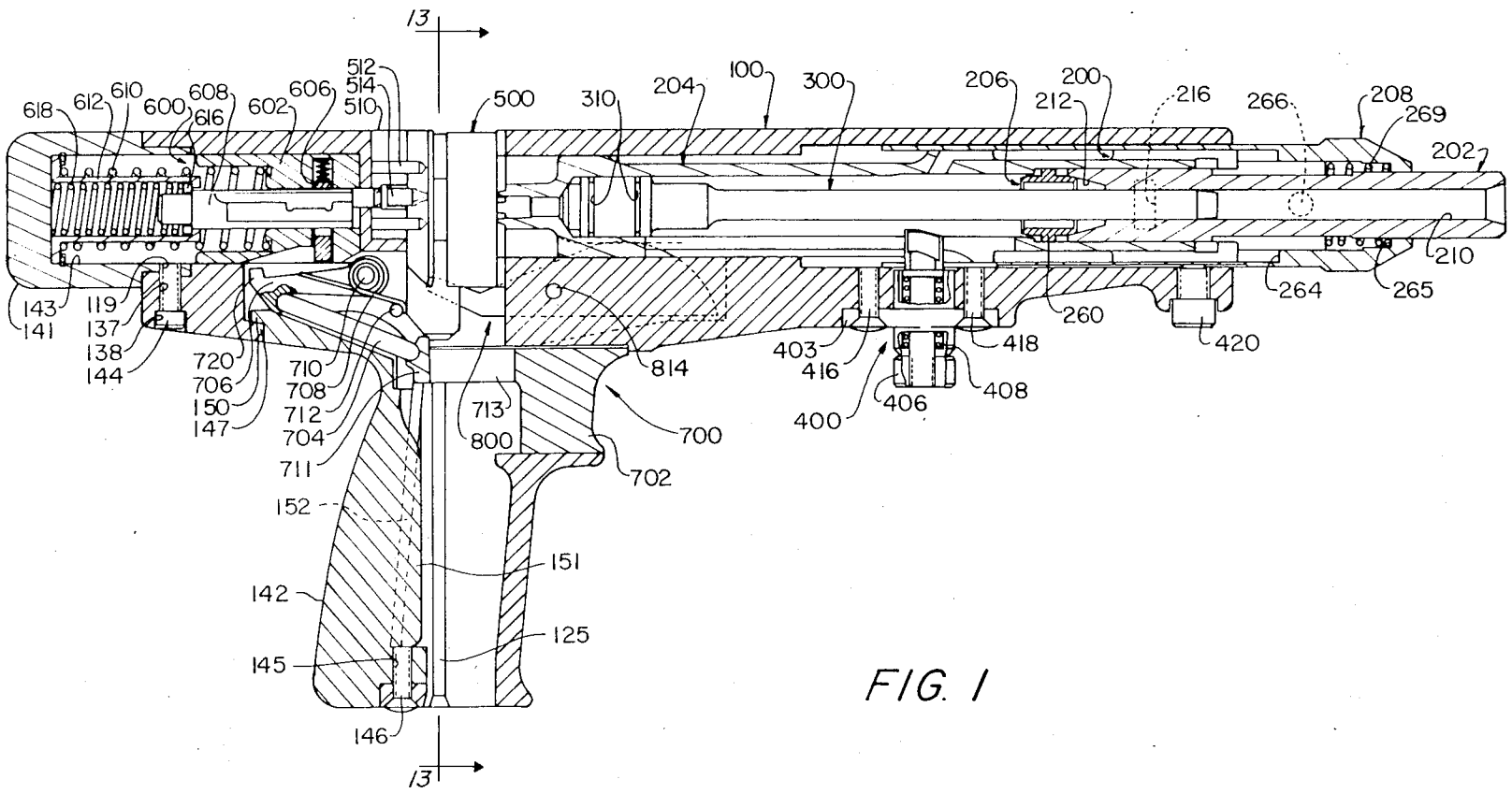
FIG. 1 is a longitudinal sectional view, with certain portions shown in side elevation and certain portions shown broken away, of a powder-actuated fastener-driving tool which comprises the preferred embodiment of the present invention.

Looking first at FIG. 1, there is shown a powder-actuated fastener-driving tool which is a preferred embodiment of the present invention. The fastener-driving tool generally comprises a housing assembly made up in part by a housing 100 and a rear cap 141, a barrel and cylinder assembly 200, a piston assembly 300, a cylinder stop assembly 400, a breech block assembly 500, a firing mechanism 600, a trigger assembly 700, and a cartridge advance mechanism 800.

Looking now at FIGS. 1, 2, 2A and 2B, housing 100 has a front bore 104, a front counterbore 106 which communicates with front bore 104 and forms a shoulder 108 at the junction thereof, a rear bore 110, a rear counterbore 112 which communicates with rear bore 110, a hollow handle section 113, and an irregular transversely-extending chamber 116 which extends from the top side of the tool to the bottom end of handle section 113, and intersects and communicates with front bore 104. Handle section 113 has an elongate opening 111 at its rear side which communicates with chamber 116, and housing 100 has a notched opening 117 on its underside which is an extension of opening 111. A tranversely-extending wall 118 separates rear bore 110 from the upper portion of chamber 116. Wall 118 has openings 120, 121, 122 and 123 which extend between rear bore 110 and chamber 116. Housing 100 also is formed with a longitudinal channel or slot 124 in the floor of front bore 104, a pair of parallel vertical channels 125 (see also FIG. 13) disposed in the inner sides of the opposite side walls of handle section 113, a first threaded bore 126 intersecting front bore 104, and second, third and fourth bores 128, 130 and 134 intersecting front counterbore 106. Bores 130 and 134 are threaded, while bore 128 is unthreaded. Bores 126, 128, 130 and 134 extend at right angles to front bore 104 and front counterbore 106. Bores 126, 128 and 130 all intersect an elliptical recess 132 formed in the bottom side of housing 100. Vertical bore 134 has a counterbore 136. Another threaded bore 137 intersects rear counterbore 112 at a right angle. Bore 137 has a counterbore 138 (FIG. 1). Still another threaded bore 139 in the bottom end of handle section 113 intersects irregular chamber 116. Bore 139 has a tapered counterbore 140 (FIG. 2). A threaded bore 175 (FIG. 2B) passes through housing 100 and intersects front bore 104.

Referring to FIG. 1, attached to housing 100 is a rear cap 141 and a resilient hand grip 142. Rear cap 141 is secured to the rear end of housing 100 so as to close off bore 110. Cap 141 is bayonet mounted to housing 100. More specifically, the latter has in counterbore 112 a plurality of mutually spaced raised segments or lands 115 (FIG. 2) that coact with similar spaced segments 154 (FIG. 10) on the inner end of cap 141 so that the cap and housing may be locked together or unlocked by simply rotating the cap relative to the housing. The cap's interior cylindrical surface 143 mates with rear bore 110 to form a single cylindrical chamber closed off at one end by the end wall of cap 141 and at the other end by housing wall 118. Cap 141 is releasably locked in place by a set screw 144 which is screwed into threaded bore 137 and projects into a locking hole 119 in cap 141.

Hand grip cushion 142 cooperates with the handle section 113 of housing 100 to form a contoured handle or grip which may be comfortably gripped by a tool operator. Cushion 142 has a tongue 150 at its upper end which overlaps a lip 147 on the underside of the housing. Cushion 142 closes off openings 117 and 111. Cushion 142 has a center rib section 151 which extends into opening 111 and engages two ribs 152 disposed on the opposite side of handle section 113, thereby preventing relative sidewise movement of the cushion. The latter is secured in place by a screw 146 which is screwed into hole 139 and also into a threaded hole 145 in the bottom end of the cushion.

Figure 4:
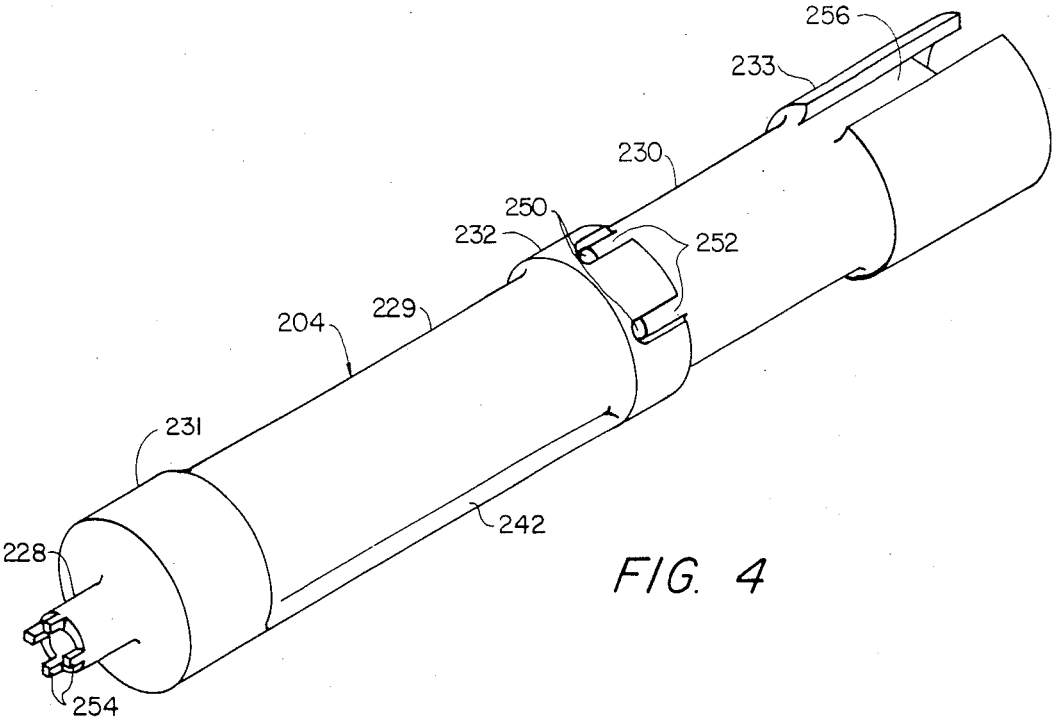
FIG. 4 is a perspective view of the tool's cylinder member.
Figure 4A:
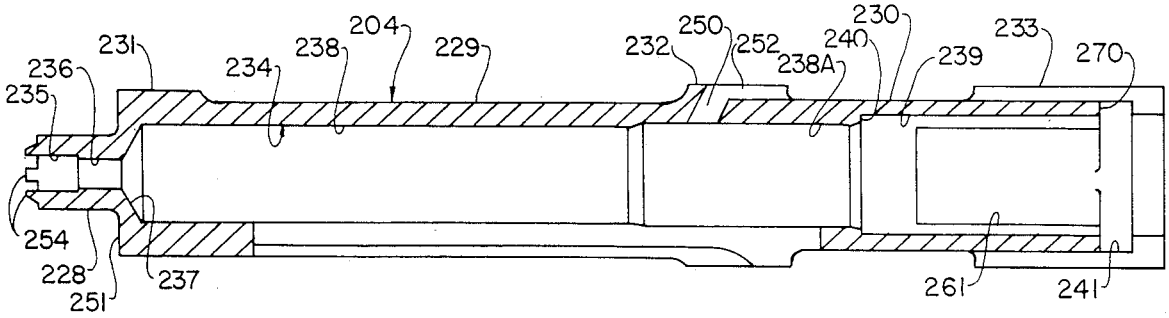
FIG. 4A is a longitudinal sectional view of the cylinder member.
Figure 5:
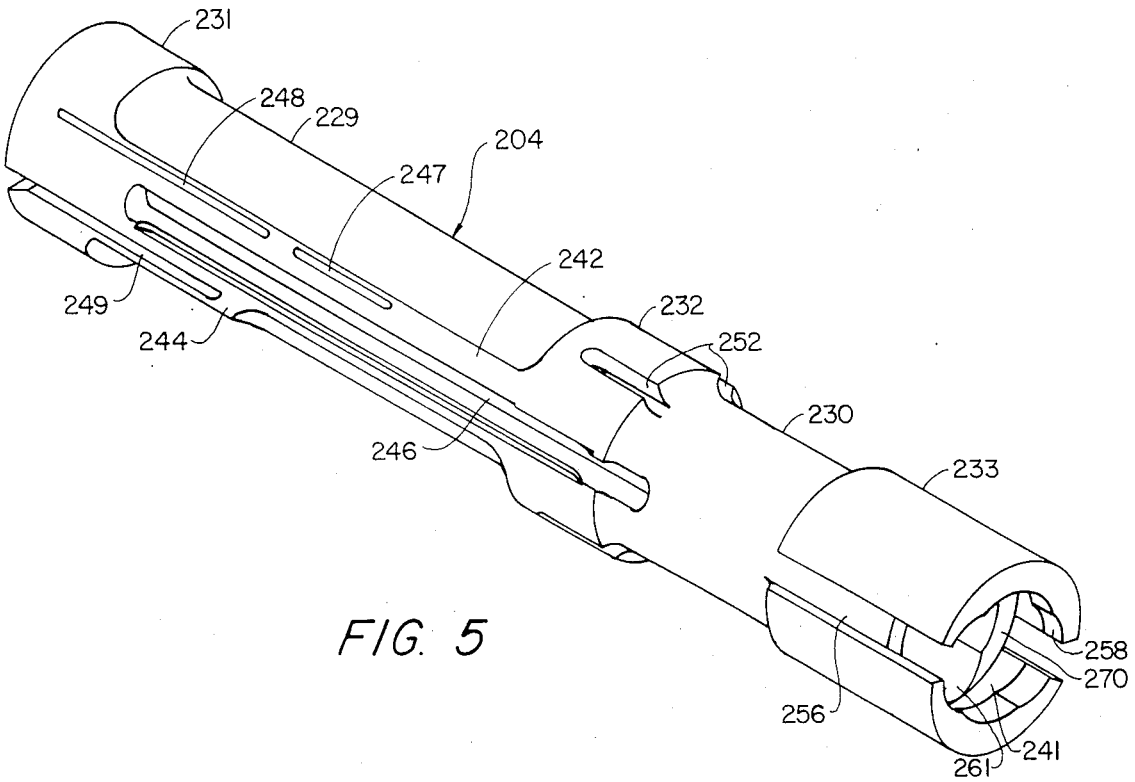
FIG. 5 is a perspective view of the same cylinder member taken from a different angle of view.
Figure 6:
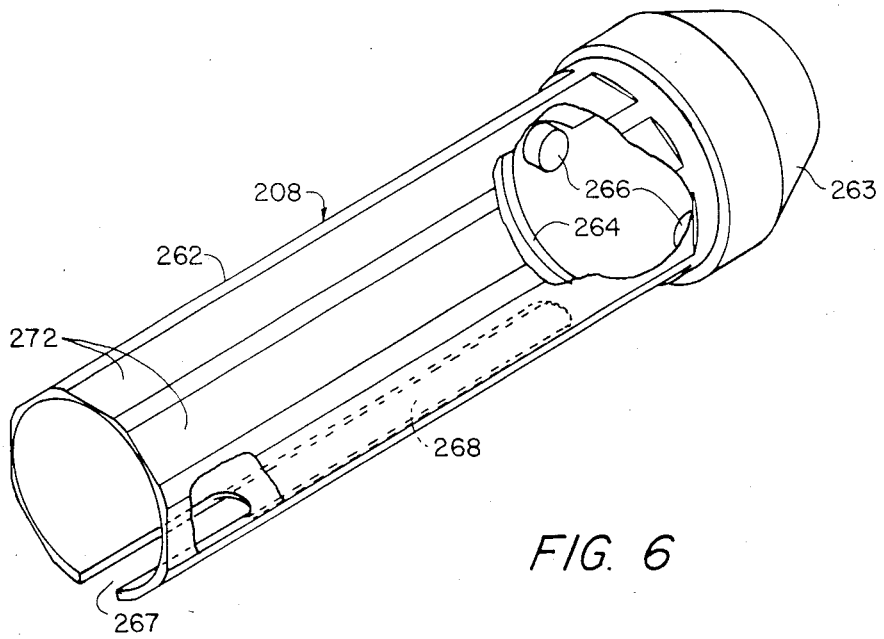
FIG. 6 is a perspective view, with portions broken away, of the tool's hand guard.

Barrel and cylinder assembly 200 is shown in detail in FIGS. 1 and 3–6. Barrel and cylinder assembly 200 generally comprises a barrel member 202 (FIG. 3), a cylinder member 204 (FIGS. 4, 4A and 5), a shock collar 206 (FIG. 1), and a hand guard 208 (FIG. 6).

Figure 3:
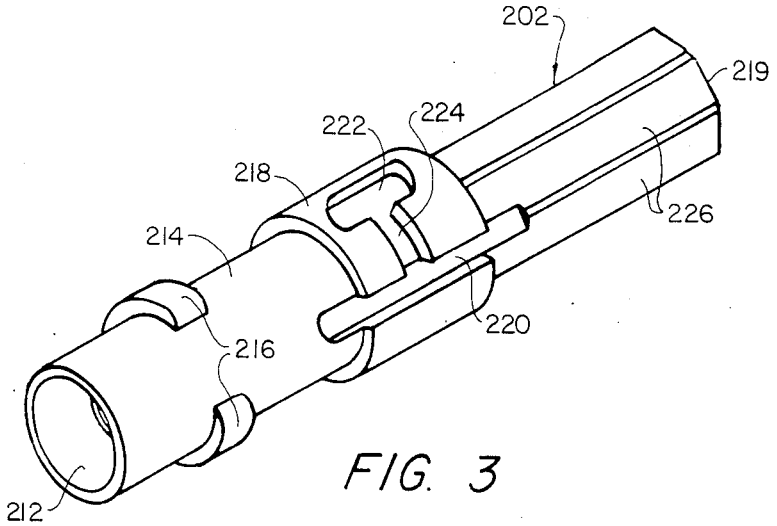
FIG. 3 is a perspective view of the tool's barrel member.

Looking now at FIGS. 1 and 3, barrel member 202 has a coaxial bore 210 of circular cross-section running for its full length. The rear end of bore 210 has a frusto-conical counterbore 212. The exterior of barrel member 202 includes a first cylindrical region 214 provided with a pair of diametrically-opposed bayonet flanges or lands 216, a second cylindrical larger diameter region 218, and a third region 219 which has a smaller diameter than the first region and has six like flats 226 which provide a hexagonal cross-sectional configuration. The second region 218 is provided with a first pair of diametrically-opposed longitudinally-extending grooves 220, a second pair of diametrically-opposed longitudinally-extending grooves 222, and a pair of diametrically-opposed circumferentially-extending grooves 224 which intersect grooves 220 and 222. It is noted that only one each of grooves 220, 222 and 224 is visible in FIG. 3. It is to be noted also that grooves 220 extend beyond the opposite ends of cylindrical region 218 into first cylindrical region 214 and third hexagonal region 219.

Looking now at FIGS. 1, 4, 4*a* and 5, cylinder member 204 has a small diameter tubular extension 228 at its rear end and its generally cylindrical exterior surface is relieved at two areas 229 and 230 so as to form three spaced lands 231, 232 and 233. Cylinder member 204 has a coaxial bore 234 that has a first small diameter section 235 commencing at the end of tubular extension 228, a second slightly smaller diameter section 236 for the remainder of tubular section 228, a frusto-conical transition section 237, a relatively large diameter section 238 extending over a major portion of its length, two still larger diameter sections 238A and 239, a frusto-conical shoulder 240, and a front counterbore 241. Exterior surface recess 229 extends through less than the full circumference of cylinder member 204, resulting in a longitudinal rib 242 that extends between lands 231 and 232 and has a rear section 244 of substantially increased width. Cylinder member 204 also has an elongated through hole 246 along rib 242 which intersects coaxial bore 234. Rib 242 also has a pair of narrow, mutually aligned grooves 247 and 248. Another wider groove 249 extends along rib 242 and land 231. Cylinder member 204 also includes a plurality of round vent holes 250 which extend radially and intersect center bore 234. Holes 250 extend at an inclined angle to the center axis of the cylinder member, as seen best in FIG. 4A. The center land 232 has a plurality of longitudinally extending slots or grooves 252 which intersect holes 250 at one end and terminate at the relieved sections 230.

Still referring to FIGS. 4, 4A and 5, the front land 233 has two diametrically opposed slots 256. Additionally, counterbore 241 is relieved at two areas in line with slots 256 as shown at 258, and bore section 239 is recessed at two diametrically opposed locations displaced 90° from recesses 258, as shown at 261. The small diameter tubular extension 228 serves as a cartridge support and for this purpose its end is slotted so as to form a plurality of fingers 254.

Looking now at FIG. 1, a resilient shock collar 206 is disposed in cylinder member 204. Collar 206 is cylindrical in cross-section and has a peripheral rib 260. The outer diameter of rib 260 is sized so that the rib makes a snug fit in bore section 239 of the cylinder member.

Looking now at FIGS. 1 and 6, hand guard 208 comprises a cylinder portion 262 having a plurality of longitudinal flats 272 disposed on the outer surface thereof, and an end portion 263 having a frusto-conically shaped outer surface. The interior surface of the hand guard is stepped along its length so as to define a pair of shoulders 264 and 265 (FIG. 1). A pair of pins 266 are welded to the interior surface of the hand guard 208 (or cast as an integral part thereof) at diametrically-opposed points. The cylinder portion 262 is slotted axially for a short distance from its rear end as shown at 267, and it also has a shallow axial groove 268 in its outer surface aligned with and extending from slot 267.

Figure 7:
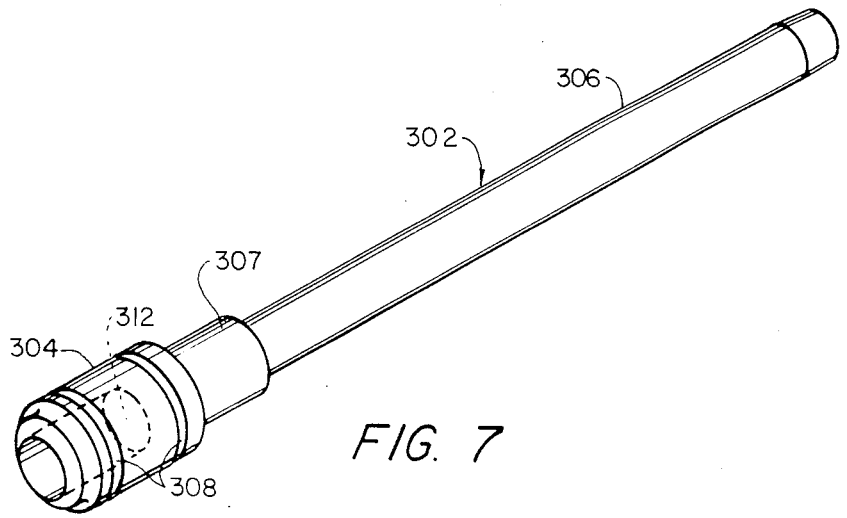
FIG. 7 is a perspective view of the tool's piston assembly.

Piston assembly 300 is shown in detail in FIGS. 1 and 7. It comprises a piston member 302 formed with a head section 304 and a shaft section 306 having an enlarged head-connecting portion 307. A pair of metal keeper rings 308 are disposed in a pair of peripheral grooves 310 formed in head section 304. As seen in FIG. 7, head section 304 also includes a blind axially extending hole 312 at its rear end which functions as a combustion chamber. Piston assembly 300 is slidably disposed within cylinder member 204 in the manner shown in FIG. 1 so that its head section 304 resides in bore section 238 of cylinder member 204. Keeper rings 308 form a tight sliding fit with the interior surface of cylinder member 204. Shaft section 306 extends through shock collar 206. Shaft section 306 is undersized with respect to the internal diameter of shock collar 206. However, the connecting portion 307 of the piston is sized so as to make a close sliding fit with the shock collar. Shaft section 306 of the piston is long enough for it to make a close sliding fit in bore 210 of barrel member 202.

Barrel member 202, cylinder member 204, shock collar 206, and hand guard 208 are all adapted to be quickly and easily assembled together so as to collectively form the complete barrel and cylinder assembly 200 in association with the piston assembly 300, in the manner shown in FIG. 1. The first step is to insert piston member 302 in cylinder member 204 so that its head section 304 is located in bore section 238. Next shock collar 206 is inserted into cylinder member 204 with its peripheral rib 260 contacting the surface defining bore section 239 of cylinder member 204. Next barrel member 202 is inserted into cylinder member 204 so that shock collar 206 protrudes into the frusto-conical counterbore 212 of the barrel member. In inserting the barrel, flanges 216 are first aligned with recesses 258, thereby allowing flanges 216 to be moved axially into contact with the shoulder 270 formed by bore section 239 and counterbore 241. Then the barrel is rotated 90°, thereby allowing the barrel to be moved into the cylinder member far enough for flanges 216 to fit in recesses 261 against shoulder 240. At this point the barrel member is locked against rotation relative to the cylinder but is free to move axially away from the cylinder member. At this point the barrel and cylinder member can be detached by moving them away from one another until flanges 216 reside in counterbore 241, at which point the barrel member can be rotated 90° to place flanges 216 in alignment with recesses 258, thereby allowing the barrel to be pulled clear of the cylinder. After barrel member 202 has been installed in cylinder member 204, barrel member 202 is coupled to hand guard 208 by a bayonet mounting arrangement hereinafter described.

To this end, a compression spring 269 (FIG. 1) is first loaded into hand guard 208 until it is entrapped between shoulder 265 and pins 266 at the front end of the hand guard. Then barrel member 202 is inserted, hexagonal end first, into hand guard 208 so that the forward end of the barrel member's second cylindrical region 218 is stopped by pins 266. Then the cylinder is rotated so as to align barrel member grooves 220 with hand guard pins 266. Then by forcing the cylinder and hand guard toward one another, the barrel is pushed further into the hand guard against the pressure of spring 269 far enough to align pins 266 with grooves 224, at which point the hand guard is rotated to move pins 266 into grooves 222. Then the hand guard and barrel member are released, thereby allowing spring 269 to force the cylinder and barrel assembly to telescope to the extent permitted by relative movement of pins 266 in grooves 222, with the result that the barrel will be locked to the hand guard by virtue of pins 266 residing in grooves 222 and spring 269 urging the barrel member and hand guard axially away from one another. At this point the cylinder member 204 and the associated piston assembly may be withdrawn and separated from the locked hand guard and barrel member by (a) pulling the cylinder member axially away from the hand guard far enough to cause flanges 216 to be aligned with counterbore 241, (b) rotating the cylinder ¼ turn so that flanges 216 are aligned with recesses 258, and then (c) pulling the cylinder member and hand guard apart.

When barrel and cylinder assembly 200 is assembled as above described, barrel member 202 is locked against rotation relative to hand guard 208, hand guard 208 and barrel member 202 are capable of telescoping movement toward one another in opposition to the bias of spring 269, and the hexagonal end of barrel member 202 extends out through the frusto-conical shaped front end of hand guard 208.

Barrel and cylinder assembly 200 and piston assembly 300 are received by housing 100 in the manner shown in FIG. 1. More specifically, and referring also to FIG. 2, barrel and cylinder assembly 200 (including piston assembly 300) is positioned within the housing so that the recessed cylindrical portion 229 of cylinder member 204 is slidably disposed partially in bore 104 and partially in counterbore 106 and the cylindrical portion 262 of hand guard 208 is slidably disposed in counterbore 106, with the front end portion of hand guard 208 and hexagonal section 219 of barrel member 202 extending out from the front end of housing 100. The outer diameter of cylindrical portion 262 is such that the hand guard makes a close sliding fit in counterbore 106 of the housing, with the flats 272 serving to define a plurality of passageways between the hand guard and adjacent inner surface of the housing for allowing gases to pass out from behind the hand guard. In installing the barrel and cylinder assembly 200 in housing 100, care is taken to make certain that (a) slot 267 of hand guard 208, grooves 220 of barrel member 202, and the elongated opening 246 and aligned slots 256 of cylinder member 204 are aligned with the housing's vertical bores 126, 128, 130 and 134, (b) groove 249 of cylinder member 204 is aligned with channel 124 of the housing, and (c) grooves 247 and 248 of cylinder member 204 are aligned with the housing's threaded bore 175 (FIG. 2B).

Installation of the barrel and cylinder assembly 200 in the housing requires manipulation of the cylinder stop assembly 400 (FIGS. 1 and 8), which serves to limit the extent to which the barrel and cylinder assembly can reciprocate in housing 100.

Figure 8:
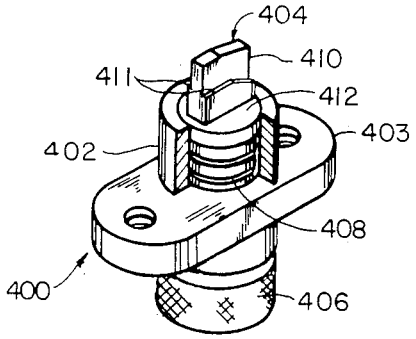
FIG. 8 is a perspective view, with portions broken away, of the tool's cylinder stop assembly.

Looking now at FIGS. 1 and 8, cylinder stop assembly 400 generally comprises a cylindrical housing 402 having an elliptical flange 403 which fits into elliptical opening 132 of housing 100, a cylinder stop pin 404 slidably disposed in housing 402 and having an enlarged knob 406 on its outer end, and a compression spring 408. Cylinder stop pin 404 is shaped so as to have a top angulated fin 410, a pair of angulated shoulders 411 on opposite sides of fin 410, and a flange 412. Spring 408 is captivated between flange 412 and knob 406. The spring biases the stop pin so that fin 410 will protrude from the top end of housing 402.

Cylinder stop housing 402 is mounted in bore 128 of housing 100 with its elliptical flange 403 received by elliptical recess 132. The cylinder stop assembly 400 is secured in place by screws 416 and 418 which are screwed into threaded bores 126 and 130 respectively. When so installed, fin 410 of cylinder stop pin 404 extends up into counterbore 106 of the housing far enough to block insertion of cylinder member 204 into bore 104. Accordingly, installation of barrel and cylinder assembly 200 into the housing requires that the elongated aperture 246 of the cylinder member and the slot 267 of the hand guard be aligned with stop pin 404, and that the stop pin be pulled out enough to permit the cylinder member to be inserted far enough to locate the rear end of its aperture 246 beyond the stop pin 404. The fin 410 is narrow enough to fit into the cylinder member's aperture 246, but the fin's shoulders 411 are just wide enough not to fit in the aperture 246, though not so wide as to prevent them from fitting in the hand guard's slot 267. Accordingly, when fin 410 is held in its extended position by spring 408, the travel of barrel and cylinder assembly 200 relative to housing 100 is limited by the length of aperture 246 in cylinder member 204. If cylinder stop knob 406 is pulled out with sufficient force to overcome spring 408, top fin 410 can be entirely withdrawn from the aperture 246 of cylinder member 204, thereby freeing the barrel and cylinder assembly 200 so that it can be removed by pulling it out of the front end of housing 100.

It is to be appreciated that the interaction of fin 410 of cylinder stop assembly 400 with the elongated opening 246 of cylinder member 204 limits both the longitudinal and the rotational travel of the barrel and cylinder assembly 200 relative to housing 100. The same interaction also assures alignment of the cylinder member's groove 249 with the housing's horizontal channel 124, alignment of the cylinder member's grooves 247 and 248 with housing bore 175, and alignment of groove 268 of the hand guard with a screw 420 which is received by threaded hole 134 and is just long enough to extend into groove 268. This co-action of groove 268 and screw 420 assures that hand guard 208 will always have its slot 267 aligned with and ready to receive top fin 410 of cylinder stop assembly 400.

A velier 425 is disposed in threaded bore 175 of housing 100 (FIG. 2B), in order to provide a limited drag on the movement of barrel and cylinder assembly 200 within housing 100. This limited drag is sufficient to keep barrel and cylinder assembly 200 substantially motionless during normal handling of the tool, e.g. during carrying about a worksite, but the drag is not so great as to interfere with intentional operational movement of the barrel and cylinder assembly with respect to the housing. Velier 425 comprises a threaded casing 428 which is screwed into bore 175, a pin 426 slidably mounted in a bore in the casing, a spring 427 forcing the pin to project into bore 104 of housing 100, and a threaded member 429 mounted in the casing so as to hold spring 427. The forward end of pin 426 is normally received by one or the other of the cylinder member's grooves 247 and 248, or bears against that part of the exterior surface of the cylinder member which extends between grooves 247 and 248.

Figure 9:
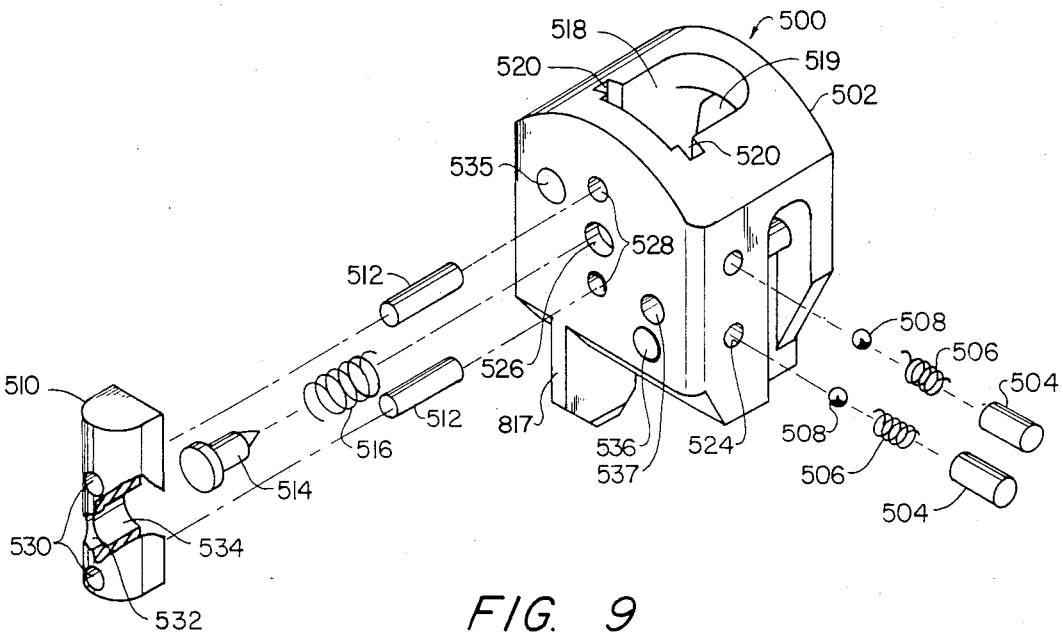
FIG. 9 is an exploded perspective view, with portions broken away, of the tool's breech block assembly.
Figure 13:
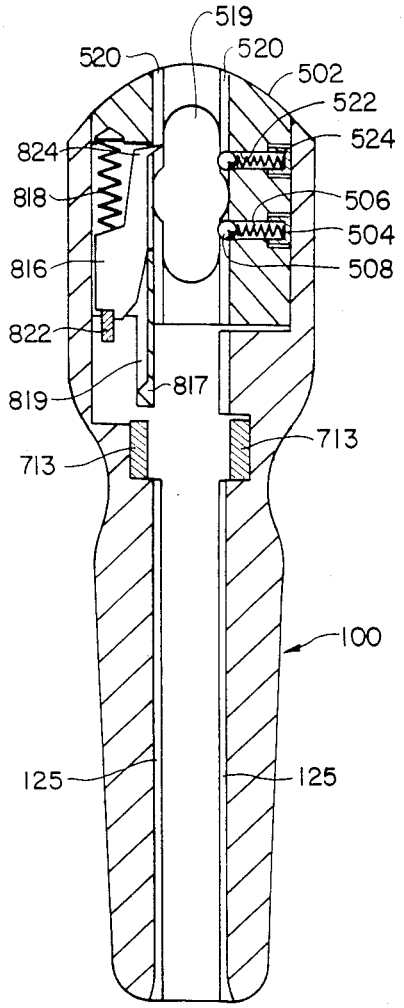
FIG. 13 is a cross-sectional view taken along line 13—13 of FIG. 1 showing portions of the tool's housing assembly, breech block assembly, cartridge advance mechanism, and trigger assembly.

Breech block assembly 500 is disposed in the upper portion of chamber 116. Looking now at FIGS. 1, 9 and 13, breech block assembly 500 generally comprises a breech block 502 which has a generally rectangular horizontal cross-section, a pair of spring cups 504, a pair of compression springs 506, a pair of steel balls 508, a firing pin housing 510, a pair of alignment dowel pins 512, a firing pin 514, and a compression-type firing pin spring 516. Firing pin housing 510 is disposed in a rear extension 153 of chamber 116. Breech block 502 is formed with an interior cavity or chamber 518 which extends through it from top to bottom, as seen in FIGS. 1, 9 and 13. Breech block 502 has a pair of oppositely disposed slots 520 which form side extensions of cavity 518. The front side of the breech block has an opening 519 (FIGS. 9 and 13) which is large enough to accommodate the cartidge support extension 228 of cylinder member 204. A pair of parallel horizontal bores 522 and matched counterbores 524 extend from one side of breech block 502 into the block and intersect slots 520. The inner ends of holes 522 are spherically tapered to a diameter slightly less than that of balls 508. Balls 508 and springs 506 are positioned in bores 522 and cups 504 are secured in counterbores 524 as shown in FIGS. 9 and 13, so that the balls 508 project partially into the slots 520 under the force of springs 506.

Breech block 502 also includes a tapered bore 526 and a pair of parallel bores 528 which pass through its rear side into cavity 518. Bores 528 are aligned with a pair of bores 530 in firing pin housing 510 so as to accommodate alignment pins 512 which extend between both breech block 502 and firing pin housing 510 (FIGS. 1 and 9). Firing pin housing 510 also has a bore 532 and a counterbore 534 which, when firing pin housing 510 is in engagement with breech block 502, coact with tapered bore 526 so as to provide a chamber for housing firing pin 514 and firing pin compression spring 516. Firing pin 514 normally resides entirely within the aforementioned chamber and, because of the action of spring 516, does not project into cavity 518 in breech block 502. However, by overcoming the force of firing pin spring 516 the firing pin can be caused to project its pointed end into interior cavity 518. Breech block 502 also includes a pair of threaded holes 535 and 536 in its rear side and a bore 537 which passes all the way through the block parallel to bores 528.

Breech block assembly 500 is secured in place in chamber 116 by a pair of screws (not shown) which pass through holes 120 and 121 in wall 118 and are screwed into holes 535 and 536 of block 502. When breech block assembly 500 is so secured in housing 100, the opposed vertical slots 520 in breech block 502 are aligned with the vertical channels 125 in housing 100 (FIG. 13), and also the axis of firing pin 514 is aligned off-center relative to the axis of cartridge support extension 228 of cylinder member 204. At the same time, bore 532 and counterbore 534 in firing pin housing 510 are aligned with opening 122 in wall 118 of housing 100, and bore 537 in breech block 502 is aligned with hole 123 in housing wall 118.

Figure 10:
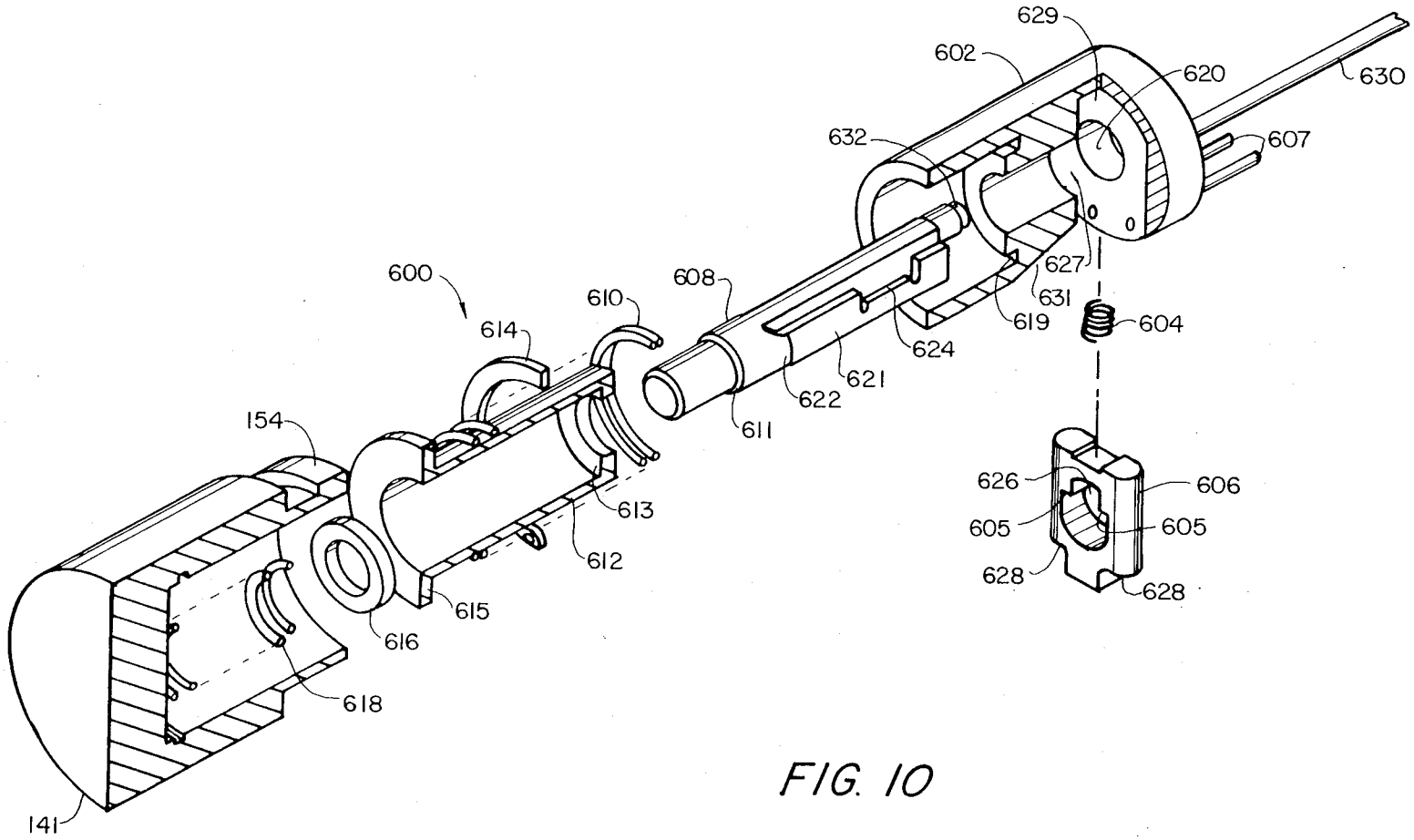
FIG. 10 is an exploded perspective view, partially in section, of the tool's firing mechanism.

Looking next at FIGS. 1 and 10, firing mechanism 600 generally comprises a firing pin actuator housing 602, three compression springs 604, 610 and 618, a latch or key release 606, a pair of retaining pins 607 a firing pin actuator 608, a spring retaining sleeve 612 having an internal front flange 613 and an external rear flange 615, a retaining ring 614, and a washer 616. Firing mechanism 600 is disposed in the chamber at the rear of housing 100 between housing wall 118 and rear cap 141. Spring retaining sleeve 612 is locked to rear cap 141 by a retaining ring 614 which is received by an interior groove in cap 141. Spring 618 forces washer 616 away from rear cap 141 and against the flange 613 of spring retaining sleeve 612. Spring 610 surrounds against the outer surface of spring retaining sleeve 612 and extends into an interior groove 619 in housing 602. Spring 610 forces firing pin housing 602 away from rear cap 141 and against housing wall 118.

Firing pin actuator 608 is disposed so that its rear end enters spring retaining sleeve 612 and its shoulder 611 can engage washer 616, while its forward end projects through a center opening 620 in actuator housing 602. Firing pin actuator 608 is formed with a pair of oppositely disposed recessed flat sides 621 each shaped to provide a flat ridge 622 (only one of which is shown) which is notched in elevation as shown at 624. Firing pin actuator 608 is designed to make a close sliding fit through a key-shaped opening 626 in latch 606. The latter is mounted in a transverse opening 627 in housing 602 and is biased by compression spring 604 which is seated in a depression 629 that is an extension of opening 627. Latch 606 is held in place in opening 627 by the two retaining pins 607 which intercept shoulders 628 of the latch. The shoulders 605 of latch 606 are arranged to side along the ridges 622 and notches 624. The notches are disposed so that when engaged by shoulders 605 the front end of the actuator will protrude slightly beyond the front end of housing 602 as shown in FIG. 1. The underside of housing 602 also is recessed as shown at 631 to receive the rear extension 720 of a release lever 706, as will hereinafter be described in detail. Also forming part of the firing mechanism is an axially extending push rod 630 which is attached to firing pin housing 602 and extends through hole 123 in wall 118 and through bore 537 in breech block 502, as will hereinafter also be described in detail.

The length of ridges 622 are set so as to permit firing pin actuator 608 to be driven forward by spring 618 enough for its front tip 632 to project through opening 620 far enough to engage and drive firing pin 514 forward, so as to fire a cartridge disposed in cartridge holder 228. If actuator housing 602 is forced backward toward cap 141 against the power of spring 610, firing pin actuator 608 will also be carried back against the force of spring 618, on account of the notched portions 624 of the actuator 608 being engaged by the shoulders 605 of the latch. If while the actuator housing 602 is compressing spring 610 latch 606 should be forced upward into housing 602 against the force of spring 604 so as to disengage shoulders 605 from notches 624, the actuator 608 will be freed and spring 618 will drive it forward with great force. Firing mechanism 600 is specifically designed so that this forward movement of firing pin actuator 608 will result in the forward end 632 of the firing pin actuator 608 passing through the opening 122 in housing wall 118, so as to contact and drive firing pin 514 forward so that its tip will intrude into the interior cavity 518 of breech block 502.

Still looking now at FIGS. 1 and 10, actuator housing 602 is adapted to be moved backward within its chamber in housing 100 on account of its attachment to push rod 630. This rod, which is affixed in the front side of actuator 602, is slidably disposed in opening 123 in housing wall 118 and through bore 537 in breech block 502, and extends into bore 104 so as to be able to engage the rear wall portion 251 of cylinder member 204 (see FIG. 4*a*). Push rod 630 is sized so that when actuator housing 602 is held forward by spring 610 in contact with wall 118 of housing 100, as it normally does in the absence of any outside forces, it may be engaged by wall portion 251 of cylinder member 204 and while so engaged, the fingers 254 at the end of cartridge support extension 228 will protrude slightly into breech block cavity 518, and the fin 410 of cylinder stop assembly 400 will be disposed intermediate the two ends of the cylinder member's bottom aperture 246. At the same time, however, push rod 630 is sized so that if the projecting hexagonal portion of barrel member 202 should be forced back into the nail-driving tool with sufficient force to overcome the action of spring 610, actuator housing 602 may be forced backwards sufficiently far within its chamber as to enable firing pin actuator 608 to effectively strike firing pin 514 if latch 606 should be subsequently moved to its release position, as noted above.

Firing mechanism latch 606 is designed to be moved upward against the force of spring 604 to its release position by trigger assembly 700. Looking now at FIGS. 1 and 13, trigger assembly 700 generally comprises a trigger 702, a trigger push rod 704, a release lever 706, a torsion spring 708, a dowel pin 710, and a dowel pin 712. Pins 710 and 712 have their opposite ends anchored in the side walls of housing 100 and they extend across the bottom opening 117 (FIG. 2) which is directly behind and communicates with cavity 116. Lever 706 is pivotally mounted on dowel pin 710. Torsion spring 708 is mounted on dowel pin 710 and has one end trapped by dowel pin 712 and its other end trapped by lever 706. Spring 708 biases lever 706 counterclockwise (as seen in FIG. 1) away from actuator housing 602. Trigger 702 is slidably mounted in a rectangular opening 703 in the front wall of handle section 113 (FIG. 2). Trigger push rod 704 has rounded ends with one end disposed in a rounded depression in the rear extension 711 of trigger 702, and the other end disposed in a rounded depression in lever 706. Push rod 704 couples trigger 702 to pin release lever 706 so that trigger 702 will normally be biased into its extended position (FIG. 1) under the influence of torsion spring 708. The forward or extended position of the trigger is determined by engagement of a portion of the trigger with a shoulder 715 of housing 100 (FIG. 2). When trigger 702 is urged rearwardly with sufficient force to overcome torsion spring 708, pin release lever 706 will be pivoted upward against actuator housing 602. The various parts are appropriately sized so that when barrel and cylinder assembly 200 is forced rearwardly into housing 100 to the extent permitted by the engagement of the forward end of cylinder aperture 246 with stop fin 410, thereby pushing actuator housing 602 rearward in its chamber, actuator latch 606 will reside directly above the extension 720 on pin release lever 706, so that if the trigger is then pulled back, the lever 706 will move up far enough for its extension 720 to engage latch 606 and raise it to release position so as to free actuator 608.

As seen in FIGS. 1 and 13, the transverse rear extension 711 of trigger 702 is coupled to the trigger by two parallel spaced connecting sections 713 which extend through the chamber 116 adjacent parallel vertical channels 125. Trigger 702, its rear extension 711, and its connecting sections 713 form an opening to accommodate a strip of gunpowder cartridges as will hereinafter be described.

Figure 11:
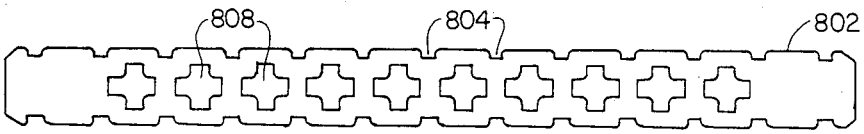
FIG. 11 is a front view of a cartridge-supporting strip used in conjunction with the tool.
Figure 12:
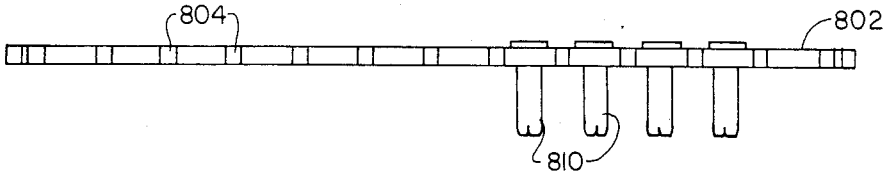
FIG. 12 is a side elevation showing a plurality of cartridges disposed in the same strip.

One such cartridge strip 802 is shown in FIGS. 11 and 12. The strip is of symmetrical design, having a plurality of uniformly spaced indexing slots 804 in its two side edges. The strip 802 also has a plurality of central openings 808, each in the form of a cross, to accommodate cartridges 810 as shown. The four slots characterizing each opening 808 are sized to accommodate the fingers 254 of cylinder member 204, so that the fingers may engage the underside of the rim of a cartridge while the tapered forward portion of the cartridge projects into cylinder extension 228.

Cartridge advance mechanism 800 serves to advance a strip 802 of cartridges 810 so that each cartridge in turn is located in firing position. Cartridge advance mechanism 800, shown in FIGS. 1, 2 and 13, generally comprises a strip feed cam 812, a dowel pivot pin 814, a pawl 816, and a spring 818. Pivot pin 814 is secured in a hole 815 which intersects slot 124 in housing 100. Strip feed cam 812 resides in housing channel 124 and pivots about dowel pin 814. Cam 812 has an upper cam surface 820 which is generally rounded but has a flat intermediate section 821. Cam surface 820 is adapted to ride in groove 249 in cylinder member 204. The rear end of cam 812 has a finger 822 which extends into slot 819 (FIG. 13) in breech block 502 in position to engage the underside of pawl 816. When cylinder member 204 reciprocates within housing 100, it causes cam 812 to pivot about dowel pin 814 and thereby alternately raise and lower its finger 822. As seen in FIGS. 9 and 13, breech block 502 has a depending fin 817, and it also has a narrow slot 819 (FIG. 13) in one side which is continued down into the outer side of fin 817. Slot 819 communicates through a vertically elongate opening with one of the cartridge strip guide grooves 520. Pawl 816 resides in slot 819. The upper end of pawl 816 has a pointed finger 824 which extends through the vertically elongate opening into groove 520 when it is in its upper position, i.e., the position shown in FIG. 13. The upper end of spring 818 resides in a depression in breech block 502 while its bottom end engages an inclined upper edge of pawl 816. Spring 818 urges the pawl (and cam finger 822) downward. When the cylinder is extended, cam finger 822 will be lower than the position shown in FIGS. 1 and 13 and so will pawl 816. Cam finger 822 engages the pawl adjacent to its lower left corner. Hence as finger 822 is raised, it applies a rotational force to the pawl which urges its finger 824 into groove 520. Hence as the pointed pawl finger 824 passes up beyond the lower border of the aperture connecting slot 819 with groove 520, the pawl finger will enter one of the notches in the cartridge strip 802 disposed in grooves 520 and cause the strip to be indexed upward with it. When cam finger 822 is no longer forced upwardly, spring 818 will cause the pawl to move down and also cause the cam finger 822 to move with it. As the pawl moves down, the slanted underside of its finger 824 will cause the pawl to move past the strip which will be held by detent balls 508. The spring 818 will also cause the pawl to rotate its finger away from the strip so as to permit the pawl to more easily move down in slot 819.

It is to be noted that a cartridge strip 802 bearing cartridges 810 may be inserted into the open bottom end of the tool handle into the opposing parallel channels 125 and pushed upward through the aforementioned opening formed by trigger parts 711 and 713 (FIGS. 1 and 13) into the grooves 520 of breech block 502, until one of the indexing slots 804 is engaged by finger 824 of pawl 816. Thereafter, each time cylinder member 204 is reciprocated forward and backward within housing 100, cam 812 will pivot to respectively lower and raise its finger 822, which in turn will cause the finger 824 of pawl 816 to move down and up respectively. On account of the slanted underside of finger 824, and the engagement of steel balls 508 of breech block assembly 500 with indexing slots 804 in the opposite edge of strip 802, each combined forward and then backward reciprocation of cylinder member 204 will cause the cartridge strip 802 to advance one step. The various members are appropriately sized so that each advancement brings a new cartridge into alignment with cartridge support projection 228 of the cylinder member 204. In this position, the axis of each cartridge 810 resides slightly below the tip of firing pin 514 so as to enable the cartridge to be rim-fired.

Operation of the fastener-driving tool will now be described.

Figure 14:
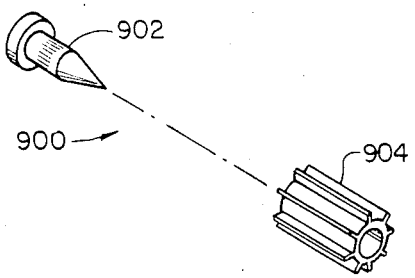
FIG. 14 is an exploded perspective view of a fastener assembly used in conjunction with the tool.

Starting with the tool in its "at rest" position, i.e. where the tool is in the state shown in FIG. 1, the tool is readied for use by inserting a cartridge strip 802 into the nail gun as previously described, so that a cartridge 810 resides inside breech block 502 aligned with and immediately behind cartridge support projection 228. Then a nail assembly 900, comprising a nail 902 engaged in a resilient finned nail support 904, as shown in FIG. 14, is inserted into the front end of central bore 210 of barrel member 202. Nail support 904 serves to keep the shaft of nail 902 aligned in the bore 210 of barrel member 202, and also provides sufficient friction with the surrounding walls of the barrel member 202 to hold nail 902 in place as the nail-driving tool is moved about. At this point, the tool is in its "ready" position.

However, if at this point a tool operator were to pull the trigger of the tool, without taking any further action, nothing would happen. This is because at this stage actuator housing 602 is held by spring 610 in its forward position engaging wall 118 of housing 100, with the result that pin release lever 706 is blocked by the underside of the actuator housing so as to be incapable of activating firing mechanism 600 to drive firing pin 514 forward to contact a cartridge 810.

Similarly, if at this point a tool operator were to grasp hand guard 208 and pull it backwards towards breech block assembly 500 and then pull the trigger, again actuator housing 602 would remain in its forward position and again nothing would happen. This is because as hand guard 208 is pulled backwards, it would move the cylinder back with it until the spring force of springs 610 and 618 exceeds the force of spring 269, whereupon backward movement of the cylinder would stop and the hand guard would simply slide backwards against the pressure of spring 269 until the end of the hand guard is stopped by engagement with shoulder 108 of housing 100. The spring force of springs 610 and 618 is sufficient to stop the backward movement of the cylinder member within the housing before the latch 606 is aligned with extension 720 of trigger lever 706. As a result, trigger 702 cannot cause firing mechanism 500 to drive firing pin 514 forward to contact a cartridge 810.

However, if while the tool is in its "ready" position, i.e., with the cylinder in the position shown in FIG. 1, the front end of barrel member 202 should be placed against a workpiece and the tool pressed forward to place it in its "fire" position, and the trigger 702 then depressed, the tool will fire. This is because forcing the tool against a workpiece to put it into its "fire" position will cause the barrel and cylinder assembly 200 to slide rearward inside the tool far enough for cylinder member 204 to chamber the cartridge 810 in its cartridge support extension 228 and at the same time, on account of push rod 630, actuator housing 602 will be forced into its rearward firing position where its latch 606 will be aligned with the projection 720 of lever 706. During this operation piston member 302 is carried backwards with cylinder member 204 on account of the tight engagement its keeper rings 308 make with the interior surfaces of the cylinder member. If now trigger 702 is pulled, it will cause pin release lever 706 to move upward, in turn forcing latch 606 upwards and thereby freeing firing pin actuator 608 so that it will move forward under the action of spring 618 and thereby drive firing pin 514 into rim contact with cartridge 810. This causes the chambered cartridge 810 to fire. The resulting hot gases of combustion flow into the interior of cylinder member extension 228 and into the combustion chamber 312 of piston member 302, thus driving piston member 302 forward within barrel and cylinder assembly 200 into contact with nail assembly 900 so as to propel the nail assembly 900 out of barrel member 202 and into the workpiece. As this occurs, substantially all of the hot gases of combustion behind piston member 302 pass along the interior of cylinder member 204 until they reach vent holes 250. The gases flow out vent holes 250, along grooves 252 formed in the cylinder member's cylindrical portion 232 and then expand into the region defined between the exterior section 230 of cylinder member 204 and the interior of hand guard 208. From there, the gases pass along grooves 256 in cylinder member 204 and enter grooves 220 in barrel member 202. Then the gases exit the tool through the spaces formed between the hexagonally disposed outer surfaces 226 of barrel member 202 and the circular interior surfaces of hand guard 208. It is to be appreciated that, by keeping slot 267 of hand guard 208 as short as possible, very little, if any, gas will be able to exit the tool via that slot. For this reason, slot 267 has a length such that it does not extend beyond the screw 420 when the tool is fired. As a result, the tool utilizes the explosive power of a cartridge 810 with great efficiency to drive the piston member.

The forward motion of piston member 302 should normally stop when its front end engages the workpiece; however, if the workpiece should fail to stop the forward motion of the piston (e.g., in the case where the workpiece is formed of soft wood), the engagement of the piston's head section 304 with shock collar 206 will stop the forward motion of piston member 302. In either case, the forward movement of piston member 302 is stopped before its head section 304 can engage top fin 410 of cylinder stop in 404.

The tool is then readied for another firing as follows. First, the tool is lifted away from its engagement with the workpiece, and then barrel and cylinder assembly 200 is disengaged from its contact with spent cartridge 810 and brought forward to the limit of aperture 246, either by pulling forward on hand guard 208 or by "throwing" the tool in a forward motion with a snap of the wrist. This action causes piston member 302 to return its head portion 304 into engagement with the rear portion of cylinder member 204, since cylinder member 204 will be moving forward within housing 100 and piston member 302 will be blocked from further forward movement by engagement of its head portion with fin 410 of cylinder stop assembly 400, so that the two parts once more occupy the position shown in FIG. 1 relative to one another. At the same time, the movement of cylinder member 204 in a forward direction within housing 100 will allow cam member 812 to pivot about dowel 814, thereby allowing spring 818 to cause pawl 816 to drop downward in slot 819 to engage another notch 804 of cartridge strip 802. Then barrel and cylinder assembly 200 is brought back to the position shown in FIG. 1 by pushing rearward on hand guard 208. As barrel and cylinder assembly 200 is returned, piston member 302 moves back with it on account of the tight engagement of keeper rings 308 with the interior of cylinder member 204. The return movement of barrel and cylinder assembly 200 causes cylinder member 204 to engage push rod 630 once more. At the same time, this return movement of barrel and cylinder assembly 200 causes cam member 812 to pivot once more on dowel 814, thereby driving pawl 816 upward and thus indexing cartridge strip 802 upward so that the spent cartridge is moved away, and a fresh cartridge is brought into position adjacent the firing pin.

At this point the fastener-driving tool has been returned to its "ready" position, as previously described. Subsequent firings are achieved by repeating the operation set forth above.

ADVANTAGES OF THE INVENTION

The powder-activated fastener-driving tool described above offers a number of advantages over the prior art.

First, the disclosed powder-actuated fastener-driving tool is mechanically simpler than many of the magazine type prior art tools, so that it is cheaper to manufacture, easier to assemble, and more reliable in operation.

Second, the disclosed tool is equipped with improved exhaust passages for venting the hot gases of combustion from the interior of the tool, so that the tool is quieter, has less recoil, is more energy efficient (and hence more powerful), and has less tendency to jam on account of the buildup of spent powder residue within the interior of the tool.

Third, the disclosed tool is capable of using a so-called "Red" charge cartridge with a light weight fastener and still be considered a "low velocity" tool.

Fourth, the tool can be easily disassembled in the field, in order to facilitate maintenance. In this respect it is noted that the entire barrel and cylinder assembly 200 can be withdrawn from the housing simply by pulling on stop knob 406 of cylinder stop assembly 400, and the entire trigger assembly 700 can be exposed simply by removing screw 146 at the bottom of handle section 113 and pulling off hand grip 142. Removal of trigger 702 is easily accomplished by pulling the trigger push rod out from between the trigger and release lever 706, and then sliding the trigger rearwardly out of the handle section: In addition, firing mechanism 600 can be withdrawn from housing 100 simply by unscrewing screw 144 from the rear of the housing and removing rear cap 141 from its bayonet connection to the housing.

Fifth, the disclosed tool can be adapted to drive fasteners of differing types and dimensions (e.g., nails, eye-pins, threaded pins, etc.) simply by removing the barrel and piston and substituting a different barrel and piston having different dimensions.

Sixth, the disclosed tool is easily adapted for use in conjunction with a pole assembly of superior design so as to form a superior pole tool, as evidenced in the following section entitled "Modification Of The Invention".

Seventh, the disclosed tool utlizes an improved trigger assembly which is simple, relatively cheap to manufacture, and does not cause the tool to jam. In some prior art tools it is difficult to remove a cartridge strip which has become jammed as a result of its being improperly made or improperly installed in the tool or the tool being used improperly. The improved trigger assembly helps to reduce such jamming and also facilitates removal of a strip which may have become jammed.

And eighth, the disclosed tool utilizes an improved cam arrangement in its cartridge advance mechanism, in the form of a flattened region on the top of the cam, to minimize cam wear and reduce maintenance and tool jamming. Additionally the groove 249 of the cylinder member assures that cam 812 will make proper contact with the cylinder member and assist in preventing rotation of the cylinder in housing 100.

It is to be noted also that cap 141 is locked to sleeve 612 so that those members plus spring 618 and washer 616 form a discrete subassembly. Hence when cap 141 is removed from housing 100, sleeve 612, spring 618 and washer 616 are removed with it.

MODIFICATION OF THE INVENTION

As previously described, the powder-actuated nail-driving tool is adapted to be utilized by a tool operator who grasps the tool about the handle portion of the housing with one hand and then activates trigger member 702 with the index finger of that hand. It is forseen, however, that it may be desired to use the tool to drive nails into certain hard-to-reach places, e.g. ceilings, in which case the tool is modified to accommodate a pole assembly 950 having a remote trigger operating mechanism as shown in FIGS. 15–17.

Figure 15A:
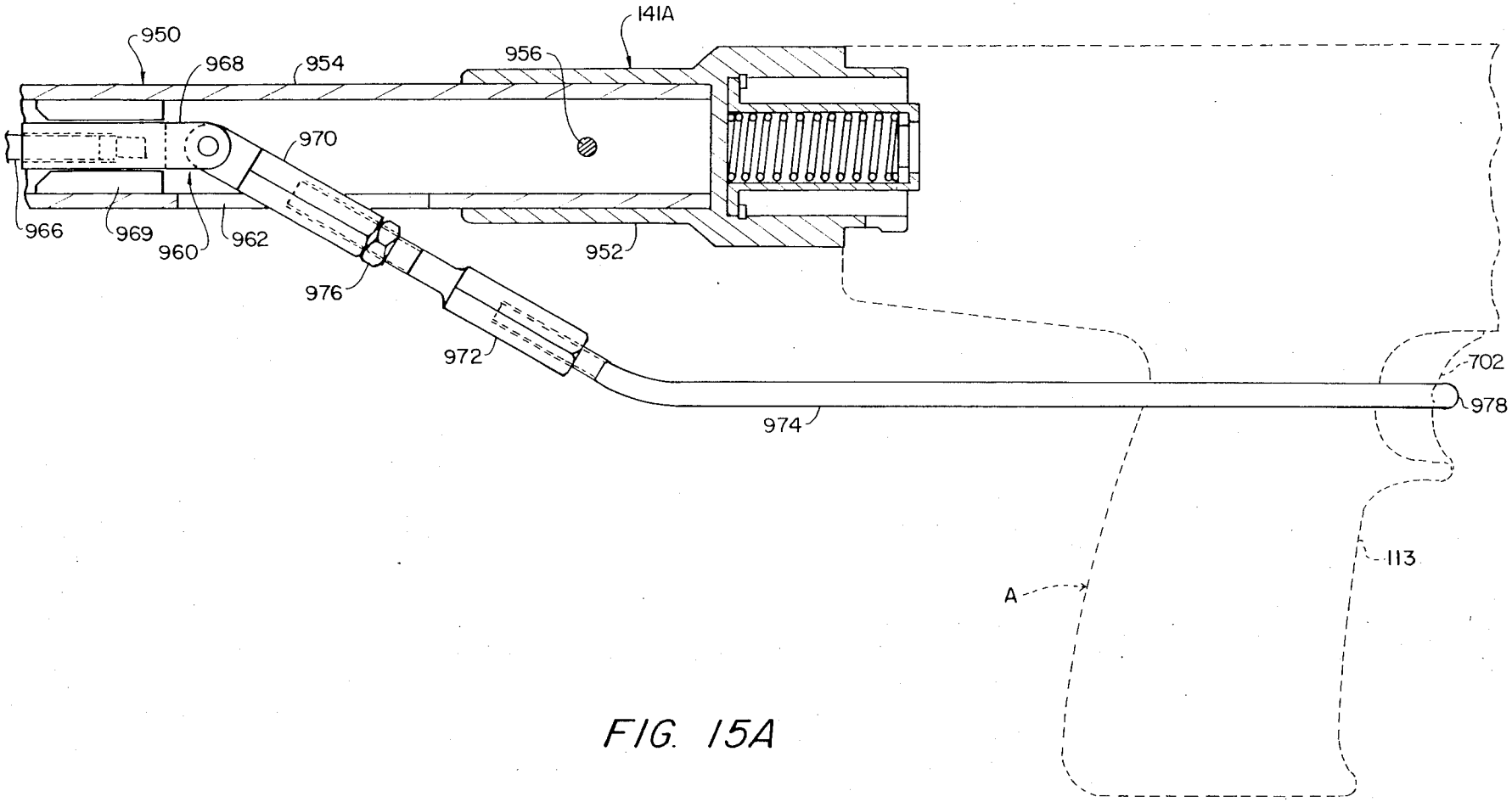
FIGS. 15A and 15B are longitudinal sectional views, with certain portions shown in side elevation and certain portions shown broken away, of a pole assembly adapted for use with the tool.
Figure 15B:
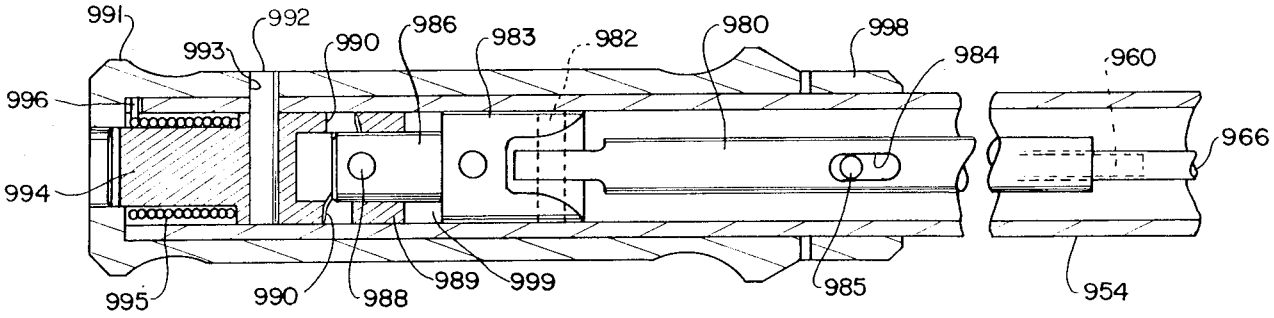
Figure 16:
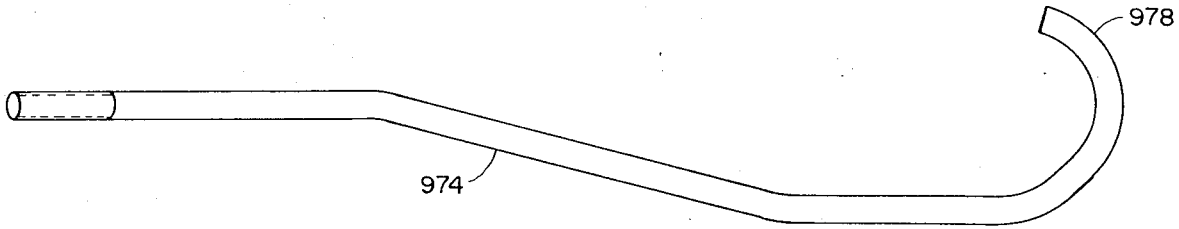
FIG. 16 is a plan view of the trigger actuator portion of the pole assembly.

Looking now at FIGS. 15A and 15B the modified tool shown in phantom at A is identical to the powder-actuated nail-driving tool previously described, except that the original tool's rear cap 141 has been replaced by a new rear cap 141*a* adapted to facilitate attachment of pole assembly 950. Cap 141*a* is the same as cap 141 except it has a hollow cylindrical extension of collar 952 at its rear end sized to receive therein one end of the pole member 954 which is part of pole assembly 950. Pole member 954 is fixed to cylindrical extension 952 by a pin 956, whereby the nailing tool is firmly attached to the end of pole member 954.

Pole member 954 is hollow in order that it may slidably accomodate a force transmitting assembly 960 therein. Pole member 954 includes a side opening 962 adjacent exension 952 to allow a portion of force-transmitting assembly 960 to extend outside of the pole and be connected to trigger 702. Force-transmitting assembly 960 comprises a solid rod 966 having a yoke 968 attached to its forward end. Yoke 968 is slidably disposed within a guide collar 969 secured within the pole. The forked end of yoke 968 is pivotally secured to a right and left hand screw coupling consisting of a first coupling member 970 which has a tapped hole into which is screwed the threaded end of a second coupling member 972. The latter in turn has a tapped hole in which is screwed the threaded end of a trigger actuating member 974. The threaded connection between coupling members 970 and 972 is right-handed while that between coupling member 972 and actuating member 974 is left-handed. As a consequence, rotating coupling member 972 in one direction will bring the actuator closer to coupling member 970 while rotating it in the opposite direction will move them further apart. A lock nut 976 on coupling member 972 is used to lock the two coupling members together. Actuator member 974 has a hooked end 978 and is shaped so as to go around one side of handle section 113 of the tool so that its hooked end will be hooked around the front edge of trigger 702. By selectively adjusting the screw coupling the trigger actuating member 974 can be made to snugly wrap around trigger member 702, thereby assuring that if force transmitting rod 966 is moved axially within pole member 954 away from end cap 141*a*, trigger member 702 will be pulled back to firing position by trigger actuating member 974.

Figure 17:
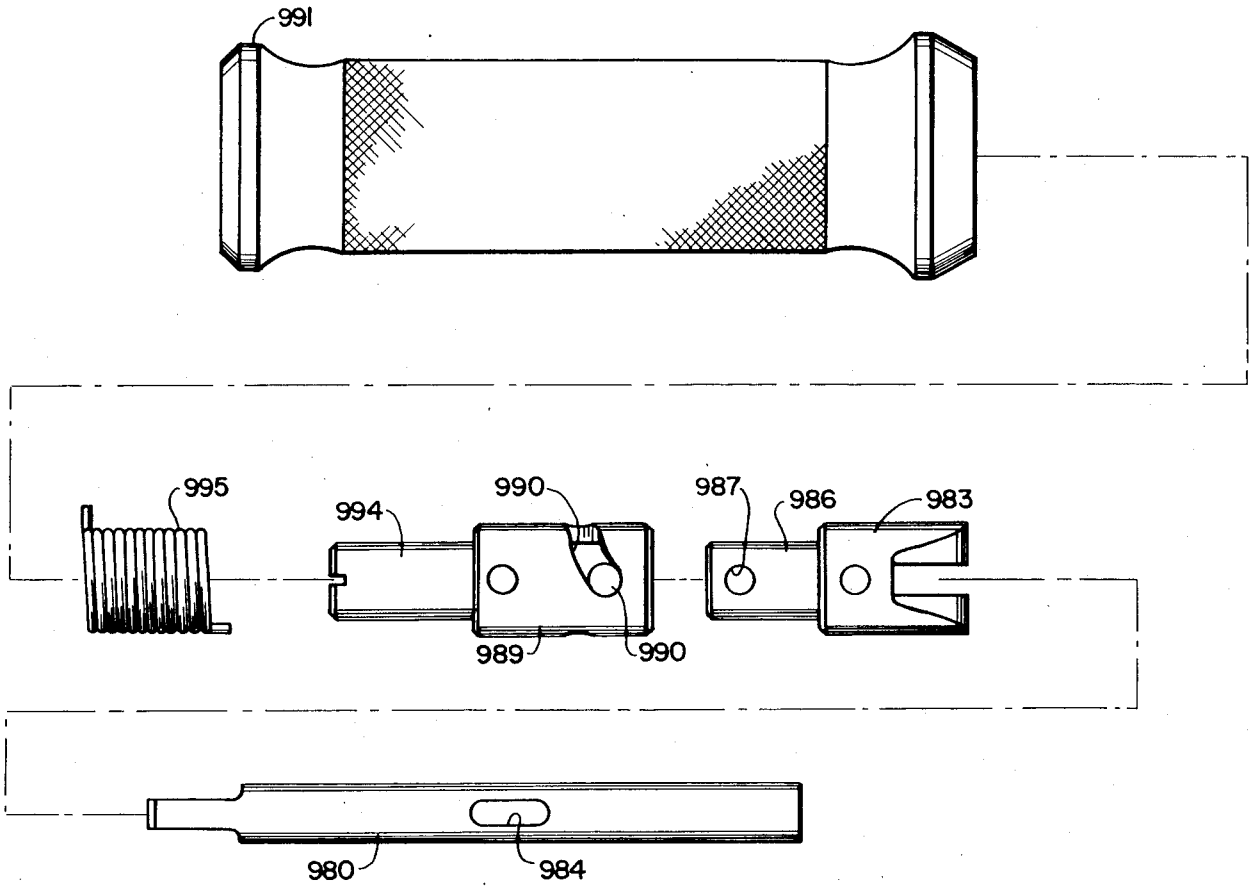
FIG. 17 is an exploded view of the handle and cam portions of the pole assembly.

Turning now to FIGS. 15B and 17, the force transmitting assembly is adapted to be moved towards and away from end cap 141*a* by a cam arrangement. More particularly, rod 966 is screwed into a plastic isolator pull rod 980 which is pivotally connected by a pivot pin 982 to the forked end of a cam follower 983. Insulator pull rod 980 has an elongated hole 984 which receives a guide pin 985 that extends cross-wise in pole 954 and is secured to handle stop collar 998. Pin 985 locks the stop collar to the pole.

Cam follower 983 comprises a reduced diameter cylindrical section 986 having a diametrically extending bore 987 (FIG. 17) which accommodates a cam follower pin 988 (FIG. 15B). The reduced diameter section 986 of the cam follower makes a close sliding fit in a hollow portion of a cylindrical cam 989 disposed within pole 954. The hollow portion of cam 989 has two diametrically opposed helically contoured holes 990 in its side wall to accommodate opposite end portions of pin 988. The length of pin 988 is the same or slightly less than the outside diameter of cam 989. Preferably pin 988 is free to slide axially in bore 987 and its ends are rounded so as to facilitate movement relative to the inner surface of the pole. Cam 989 is secured to a cylindrical handle 991 which rotatably surrounds pole 954 by means of a pin 992. The latter extends through a hole 993 in pole 954 which is elongated circumferentially through an angle of about 90 degrees so as to permit the handle to be rotated a quarter turn relative to the pole. Cam 989 has a reduced diameter section 994 which is surrounded by a torsion spring 995. One end of spring 995 is anchored in a slot in cam 989 while its other end is trapped in a hole 996 in the side wall of pole 954.

Spring 995 biases the cam so that cam pin 988 normally resides in the ends of holes 990 which are nearest to cam follower 983, so that a gap 999 exists between them as shown in FIG. 15B. The left and right hand coupling is set so that when gap 999 exists, the actuating member will lie close to but will not exert any pressure on trigger member 702. However, if handle 991 is turned relative to pole 954, pin 988 coacts with holes 990 so as to reduce gap 999 and the force-transmitting assembly 960 will move away from rear cap 141*a* and thereby cause trigger member 702 to be depressed. Thus, if a cartridge is disposed in the breech block in firing position and handle 991 is rotated approximately a quarter turn while the barrel of the tool is pressed against a ceiling, the handle rotation will cause the tool to fire the cartridge and thereby drive a nail in the ceiling.

It will, of course, be appreciated that pole assembly 950 may be fabricated in varying lengths depending on the job at hand. In any event, firing the tool by rotating the handle is advantageious in that the operator can grasp the handle as well as the pole to press the tool against an overhead workpiece. Also the rotational mode of operation reduces the risk of accidental firing of the tool. In addition, the pole assembly lacks protruding external parts which can cause accidents. Prior pole assemblies commonly are actuated by bicycle handbrake levers which are prone to accidental operation. It is to be noted that for reasons of cost and strength the components of the pole assembly are made of metal, e.g., aluminum and steel. However, the pole 954 and isolator member 980 is made of plastic in order to electrically insulate the trigger actuator from the cam assembly.

What is claimed is:

1. In a powder-actuated fastener-driving tool of the type comprising:

(a) a housing having a first opening therein;

(b) a barrel and cylinder assembly disposed in said first opening and adapted for reciprocal movement in said housing, said barrel and cylinder assembly comprising (1) a hollow barrel, and (2) a hollow cylinder member having a front end and a rear end and first and second longitudinally extending grooves, said barrel being mounted to said cylinder member so that the two members act as a single unit, with said barrel being disposed in the front end of said cylinder member and extending outward therefrom, and further wherein said barrel and cylinder assembly comprises a hand guard that surrounds a portion of said barrel and said cylinder member and is keyed to said barrel so as to permit limited reciprocal movement of the hand guard lengthwise of the barrel, with said hand guard having a substantially cylindrical portion with a slot therein aligned with said first groove;

(c) a piston assembly disposed within said barrel and cylinder assembly and adapted for reciprocal movement therein;

(d) a cylinder stop assembly comprising a cylinder stop housing and projecting stop means yieldably supported by said stop housing, said cylinder stop assembly being mounted to said housing so that said stop means normally extends into said first groove in said cylinder member so as to limit the longitudinal and rotational travel of said barrel and cylinder assembly relative to said housing;

(e) a breech block assembly comprising a breech block having a longitudinally-extending bore and a central chamber, a firing pin yieldably mounted in said breech block assembly so as to be capable of intruding into said central chamber upon the application of a suitable force thereto;

(f) a firing mechanism comprising a firing actuator, movable means slidably supporting said actuator, spring means biasing said actuator and said movable means toward said breech block, latch means releasably locking said actuator to said movable means, and a push rod extending through said breech block bore and contacting said barrel and cylinder assembly so that movement of said barrel and cylinder assembly within said housing toward said breech block will cause said push rod to move said movable means away from said breech block so as to store energy in said spring means, whereby said spring means can act to drive said actuator forward against said firing pin when said latch means is released from said actuator;

(g) trigger means for operating said latch means; and (h) a cartridge advancing mechanism comprising a cam movable in said second groove, a pawl and a spring, said cartridge advancing mechanism being adapted to advance a strip of cartridges so as to position a cartridge in firing position adjacent said cylinder member and said firing pin as said cylinder and barrel assembly is reciprocated;

the improvement wherein;

said trigger means comprises a release lever, a first pivot pin rotatably supporting said release lever for movement toward and away from said firing mechanism, a torsion spring coupled to said release lever and a second pin so as to yieldably bias said release lever away from said firing mechanism, a trigger, and a trigger push rod releasably engaged with and extending between said trigger and said release lever so as to cause said trigger to force said release lever in a direction to operate said latch means when said trigger is pulled, whereby to cause said firing actuator to propel said firing pin forward to fire a cartridge disposed in line with said cylinder; and said slot commences at the rear end of said hand guard and terminates short of the rear end of said barrel.

2. A tool according to claim 1 further wherein said tool includes a pole assembly attached to said housing for maneuvering said tool and causing said trigger to operate said firing mechanism, said pole assembly comprising a hollow pole having first and second opposite ends with said first end secured to said housing, a trigger actuator engaged with said trigger, a force-transmitting mechanism connected to said trigger actuator and extending within said pole, means coupling said force-transmitting mechanism to said trigger actuator, a handle rotatably mounted to said pole at said second end thereof, and cam means located at said second end of said pole coupling said handle to said force-transmitting mechanism for causing said force-transmitting means to pull said trigger when said handle is rotated relative to said pole.

3. A tool according to claim 1 wherein said cylinder member comprises first, second and third upraised cylindrical portions thereon, said first portion being disposed at said rear end of said cylinder member adjacent said breech block assembly, said second portion being disposed about the middle of said cylinder member, and said third portion being disposed at said front end of said cylinder member remote from said breech block assembly, and further wherein said cylinder member comprises a longitudinal rib extending between said first and second cylindrical portions, said longitudinal rib having a rear section of enlarged width, with said first groove being disposed in said longitudinal rib and said second groove being disposed in said rear rib section, and further wherein said second cylindrical portion of said cylinder member includes a plurality of holes extending at an acute angle relative to the longitudinal axis of said cylinder member, said holes being open to the interior space of said cylinder member so as to vent gases formed by the firing of a cartridge under the action of said firing mechanism, and further wherein said third portion has means for exhausting gases around said cylinder.

4. A tool according to claim 3 wherein said second cylindrical portion of said cylinder member includes a number of grooves therein, said grooves communicating with said holes and extending along said second cylindrical portion towards said third cylindrical portion so as to direct gases vented by said holes toward the forward end of said cylinder.

5. A tool according to claim 1 wherein said hand guard further comprises a surface groove aligned with said slot, said surface groove commencing at the forward end of said slot and extending forward thereof, and means on said housing extending into said surface groove so as to prevent rotation of said hand guard relative to said cylinder.

6. A tool according to claim 5 wherein said substantially cylindrical portion of said hand guard is comprised of a plurality of adjoining flat surfaces surrounded by but spaced from said housing so as to provide passageways for exhausting gases from said housing.

7. A power-actuated fastener-driving tool of the type comprising:

(a) a housing having a first opening therein;

(b) a barrel and cylinder assembly disposed in said first opening and adapted for reciprocal movement in said housing, said barrel and cylinder assembly comprising (1) a hollow barrel, and (2) a hollow cylinder member detachably secured to said barrel and having first and second longitudinally extending grooves, said barrel being secured to said cylinder member so that the two members act as a single unit;

(c) a piston assembly slidably disposed within said barrel and cylinder assembly;

(d) a cylinder stop assembly comprising projecting means normally extending into said first groove in said cylinder member so as to limit the longitudinal and rotational travel of said barrel and cylinder assembly realtive to said housing;

(e) a breech block assembly mounted in a second opening in said housing that communicates with said first opening, said breech block assembly comprising a breech block having a central chamber, a bore, guide means in said block for slidably receiving a strip of powder-filled cartridges, and detent means for releasably holding said strip in said breech block;

(f) a firing pin housing mounted in said second opening in said housing in back of said breech block, a hole in said firing pin housing extending parallel to said barrel and intersecting said central chamber, a firing pin mounted in said hole, and spring means yieldably restraining said firing pin so as keep it out of said central chamber until a suitable force is applied to said firing pin;

(g) a firing mechanism comprising a firing actuator, a firing actuator support slidably mounted in a support chamber in said housing and slidably supporting said actuator, said support chamber comprising an end wall separating said support chamber from said firing pin housing, first spring means biasing said actuator toward said end wall, second spring means biasing said actuator for movement toward said end wall relative to said firing actuator support, latch means for locking said actuator to said firing actuator support, spring means normally biasing said latch means into locking relation with said actuator, and a push rod attached to said support means, said push rod extending through an opening in said end wall and said breech block bore and contacting said cylinder so that movement of said barrel and cylinder assembly in a rearward direction within said housing will cause said push rod to move said support means in a rearward direction so that said firing actuator will be capable of applying a force to the rear of said firing pin if said latch means is then released to unlock said actuator;

(h) trigger means for releasing said latch means, said trigger means comprising (1) a trigger movably mounted to said housing, said trigger having a front section for operator engagement, a rear section formed with a first round depression, and a middle section integrally connecting said front section and said rear section, said middle section being bifurcated so as to allow said strip of cartridges to pass therethrough, (2) a pivot pin mounted to said housing, (3) a lever movably mounted to said pivot pin and adapted for movement toward and away from said firing mechanism, said lever having a second round depression, (4) a dowel pin mounted to said housing, (5) a torsion spring coupled to said lever and said dowel pin and adapted to urge said lever away from said firing mechanism, and (6) a trigger push rod releasably engaged with and extending between said trigger and said lever, said trigger push rod constituting a rod with rounded ends seated in said first and second depressions and retained there by the force exerted by said torsion spring on said lever, whereby when said trigger is pulled said lever will (a) engage and release said latch means if said actuator support is held back by said cylinder, whereby to cause said firing actuator to propel said firing pin forward to fire a powder-filled cartridge disposed in line with said cylinder member, or (b) engage and be blocked by said actuator support if said actuator support is forward against said end wall; and (i) a cartridge advance mechanism comprising a cam, a pawl and a spring, said cartridge advance mechanism being adapted to advance a strip of powder-filled cartridges along said guide means in said breech block so as to position a cartridge in firing position adjacent said cylinder and said firing pin as said cylinder and barrel assembly is reciprocated.

8. A tool according to claim 7 wherein said cylinder member comprises first, second and third upraised cylindrical portions thereon, said first portion being disposed at one end of said cylinder member adjacent said breech block, said second portion being disposed about the middle of said cylinder member, and said third portion being disposed at the opposite end of said cylinder member remote from said breech block, and further wherein said second cylindrical portion of said cylinder member includes a number of holes extending at an acute angle relative to the longitudinal axis of said cylinder member, said holes leading through to the interior space of said cylinder member so as to vent gases formed by the firing of a cartridge by said firing mechanism, and further wherein said barrel and cylinder assembly comprises means for channeling gases produced by the firing of a cartridge along the outside of said cylinder member and barrel.

9. A tool according to claim 8 wherein said second cylindrical portion of said cylinder member includes a number of grooves therein, said grooves communicating with said holes and extending along said second cylindrical portion towards said third cylindrical portion so as to direct gases vented by said holes toward the forward end of said barrel.

10. A tool according to claim 9 wherein said barrel and cylinder assembly includes a hand guard, said hand guard having a substantially cylindrical portion with a slot therein and a groove continuous with said slot, said slot and said groove being aligned with one another, and said groove terminating short of a substantially frusto-conical second portion and further wherein said cylinder stop means extends into said hand guard slot and said cylinder member's first groove to limit telescoping movement of said cylinder member in said housing, and further wherein said tool comprises means in said housing extending into said hand guard groove for preventing rotation of said hand guard relative to said housing without impeding telescoping movement of said hand guard relative to said housing.

11. A tool according to claim 10 wherein said substantially cylindrical portion of said hand guard is comprised of a plurality of adjoining flat surfaces surrounded by but spaced from said housing so as to provide passageways for exhausting gases from said housing.

* * * * *